US010553152B2

(12) United States Patent
Chen et al.

(10) Patent No.: US 10,553,152 B2
(45) Date of Patent: Feb. 4, 2020

(54) PIXEL STRUCTURE

(71) Applicant: InnoLux Corporation, Miao-Li County (TW)

(72) Inventors: Lien-Hsiang Chen, Miao-Li County (TW); Kung-Chen Kuo, Miao-Li County (TW); Ming-Chun Tseng, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 502 days.

(21) Appl. No.: 15/244,218

(22) Filed: Aug. 23, 2016

(65) Prior Publication Data

US 2017/0061884 A1 Mar. 2, 2017

(30) Foreign Application Priority Data

Aug. 25, 2015 (CN) ..... 2015 1 0526551

(51) Int. Cl.
*G09G 3/3233* (2016.01)

(52) U.S. Cl.
CPC ... *G09G 3/3233* (2013.01); *G09G 2300/0819* (2013.01)

(58) Field of Classification Search
CPC .... G09G 3/325; G09G 3/3233; G09G 3/3241; G09G 3/3258; G09G 2300/0819;
(Continued)

(56) References Cited

U.S. PATENT DOCUMENTS

2011/0279484 A1* 11/2011 Han ..... G09G 3/3233 345/690
2014/0022150 A1* 1/2014 Guo ..... G09G 3/3233 345/76

(Continued)

FOREIGN PATENT DOCUMENTS

CN 104064139 A 9/2014
CN 104269133 A 1/2015

OTHER PUBLICATIONS

Chinese language office action dated May 31, 2018, issued in application No. CN 201510526551.6.

*Primary Examiner* — William Boddie
*Assistant Examiner* — Jeffrey Parker
(74) *Attorney, Agent, or Firm* — McClure, Qualey & Rodack, LLP

(57) ABSTRACT

A pixel structure including a data transistor, a switching transistor, a driving transistor, a compensation transistor, an illumination transistor, an organic light-emitting diode (OLED) and a first capacitor is provided. The data transistor transmits a data signal to a node according to a scan signal. The switching transistor provides a first reference signal to the node according to a first illumination signal. The driving transistor includes a gate, a source receiving a first operation voltage and a drain. The compensation transistor is coupled between the gate and the drain and receives a control signal. The illumination transistor receives a second illumination signal and is coupled to the drain. The OLED includes an anode coupled to the illumination transistor and a cathode receiving a second operation voltage. The first capacitor is coupled between the node and the gate.

13 Claims, 11 Drawing Sheets

(58) Field of Classification Search
CPC ... G09G 2300/0876; G09G 2320/0233; G09G 2320/045
See application file for complete search history.

(56) References Cited

U.S. PATENT DOCUMENTS

2014/0347405 A1* 11/2014 Kumeta ..... G09G 5/10 345/690
2015/0356916 A1* 12/2015 Qian ..... G09G 3/3233 345/78
2017/0103706 A1* 4/2017 Yang ..... G06F 3/0416
2018/0174512 A1* 6/2018 Yuan ..... G09G 3/32

* cited by examiner

PIXEL STRUCTURE

CROSS REFERENCE TO RELATED APPLICATIONS

This application claims priority of China Patent Application No. 201510526551.6, filed on Aug. 25, 2015, the entirety of which is incorporated by reference herein.

BACKGROUND OF THE INVENTION

Field of the Invention

The invention relates to a pixel structure, and more particularly to a pixel structure with an organic light-emitting diode (OLED).

Description of the Related Art

In recent years, the image quality provided by flat-panel displays has gradually improved. The profile of the flat-panel displays are thin and the weight of the flat-panel displays are light. Therefore, the flat-panel displays are a mainstream display device. Generally, the display panel of each flat-panel display comprises a plurality of pixels. Each pixel comprises a driving transistor and an illumination element. The driving transistor generates a driving current according to an image signal. The illumination element displays corresponding brightness according to the driving current.

However, the driving transistors of the different pixels may comprise different threshold voltages due to manufacturing procedures. Therefore, when the driving transistors with different threshold voltages receive the same image signal, the driving transistors may generate different driving currents so that the illumination elements display different brightness. Additionally, when the operation voltages of the driving transistors are shifted, the illumination elements also display different brightness.

BRIEF SUMMARY OF THE INVENTION

In accordance with an embodiment, a pixel structure comprises a data transistor, a switching transistor, a driving transistor, a compensation transistor, an illumination transistor, an organic light-emitting diode (OLED) and a first capacitor. The data transistor has a first terminal coupled to a data signal, a second terminal connected to a node, and a gate terminal coupled to a scan signal. The switching transistor has a first terminal coupled to a first reference signal, a second terminal connected to the node, and a gate terminal coupled to a first illumination signal. The driving transistor has a gate terminal, a first terminal coupled to a first operation voltage, and a second terminal. The compensation transistor has a gate terminal coupled to a control signal, a first terminal connected to the gate terminal of the driving transistor, and a second terminal connected to the second terminal of the driving transistor. The illumination transistor has a gate terminal coupled to a second illumination signal, a first terminal connected to second terminal of the driving transistor, and a second terminal. The organic light-emitting diode (OLED) has an anode coupled to the second terminal of the illumination transistor and a cathode coupled to a second operation voltage. The first capacitor is coupled between the node and the gate terminal of the driving transistor. During a reset period, a voltage level of the gate terminal of the driving transistor is equal to a second reference signal. During a compensation period, the voltage level of the gate terminal of the driving transistor is equal to a first sum of the first operation voltage and an absolute value of a threshold voltage of the driving transistor. During an illumination period, the voltage level of the gate terminal of the driving transistor is equal to a second sum of a difference between the second reference signal and the data signal and the first sum.

In accordance with another embodiment, an electronic device comprises a gate driver, a source driver and a plurality of pixels. The gate driver provides at least one scan signal. The source driver provides at least one data signal. Each pixel comprises a data transistor, a switching transistor, a driving transistor, a compensation transistor, an illumination transistor, an OLED and a first capacitor. The data transistor has a first terminal coupled to the data signal, a second terminal connected to a node, and a gate terminal coupled to the scan signal. The switching transistor has a first terminal coupled to a first reference signal, a second terminal connected to the node, and a gate terminal coupled to a first illumination signal. The driving transistor has a gate terminal, a first terminal coupled to a first operation voltage, and a second terminal. The compensation transistor has a gate terminal coupled to a control signal, a first terminal connected to the gate terminal of the driving transistor, and a second terminal connected to the second terminal of the driving transistor. The illumination transistor has a gate terminal coupled to a second illumination signal, a first terminal connected to second terminal of the driving transistor, and a second terminal. The organic light-emitting diode (OLED) has an anode coupled to the second terminal of the illumination transistor and a cathode coupled to a second operation voltage. The first capacitor is coupled between the node and the gate terminal of the driving transistor. During a reset period, a voltage level of the gate terminal of the driving transistor is equal to a second reference signal. During a compensation period, the voltage level of the gate terminal of the driving transistor is equal to a first sum of the first operation voltage and an absolute value of a threshold voltage of the driving transistor. During an illumination period, the voltage level of the gate terminal of the driving transistor is equal to a second sum of a difference between the second reference signal and the data signal and the first sum.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
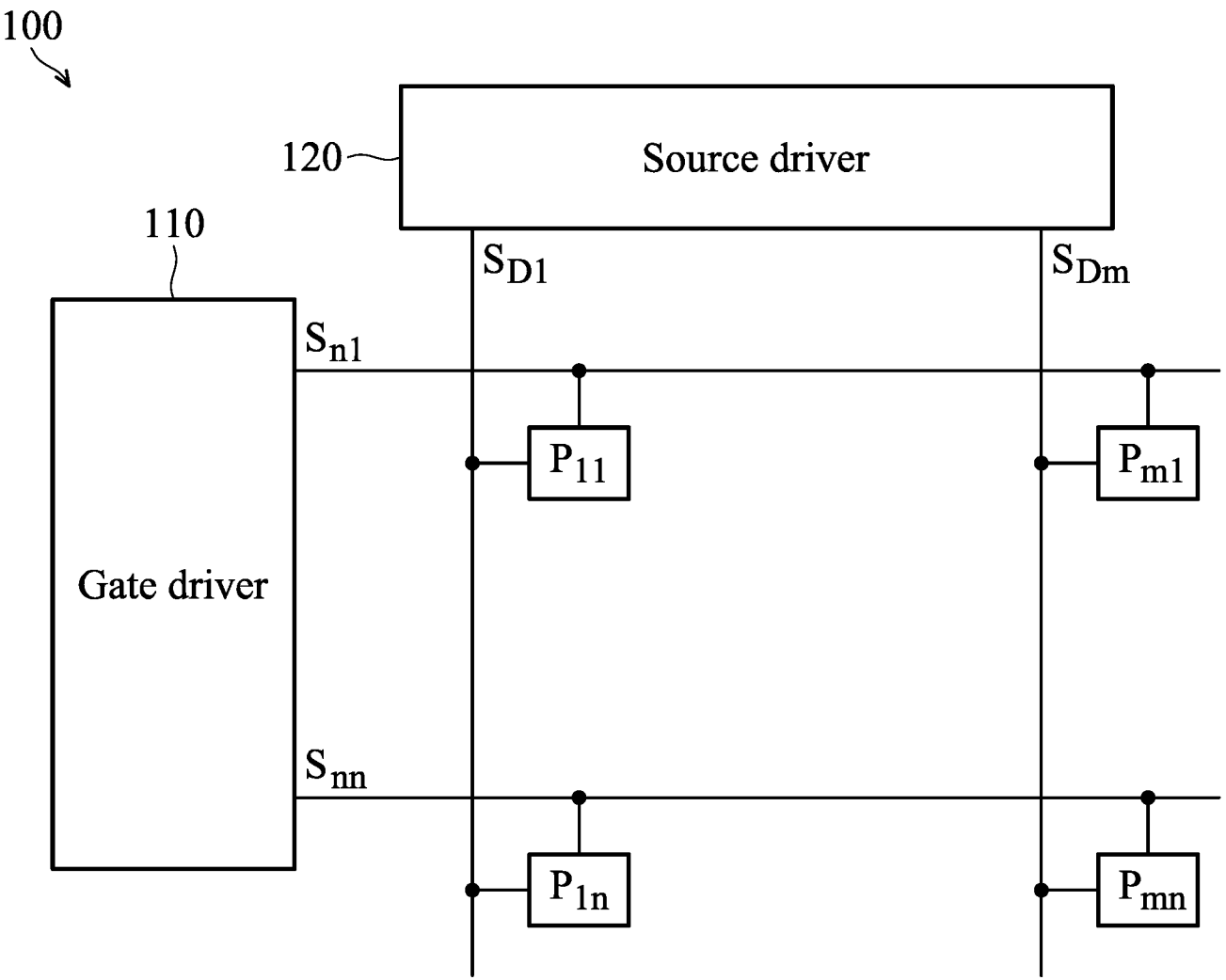
FIG. 1 shows an exemplary embodiment of an electronic device, according to various aspects of the present disclosure.

FIG. 1 shows an exemplary embodiment of an electronic device, according to various aspects of the present disclosure. As shown in FIG. 1, the electronic device 100 comprises a gate driver 110, a source driver 120 and a plurality of pixels $P_{11}$~$P_{mn}$. The invention does not limit the kind of electronic device 100. In one embodiment, the electronic device 100 is a personal digital assistant (PDA), a cellular phone, a digital camera, a television, a global positioning system (GPS), a display for cars, an aerial display system, a digital photo frame, a notebook computer or a personal computer.

The gate driver 110 provides scan signals $S_{n1}$~$S_{nn}$. The source driver 120 provides data signals $S_{D1}$~$S_{Dm}$. Each of the pixels $P_{11}$~$P_{mn}$ receives a corresponding scan signal and a corresponding data signal. For example, the pixel $P_{11}$ receives the scan signal $S_{n1}$ and the data signal $S_{D1}$. The pixel $P_{11}$ is provided as an example to describe the circuit structure.

Figure 2A:
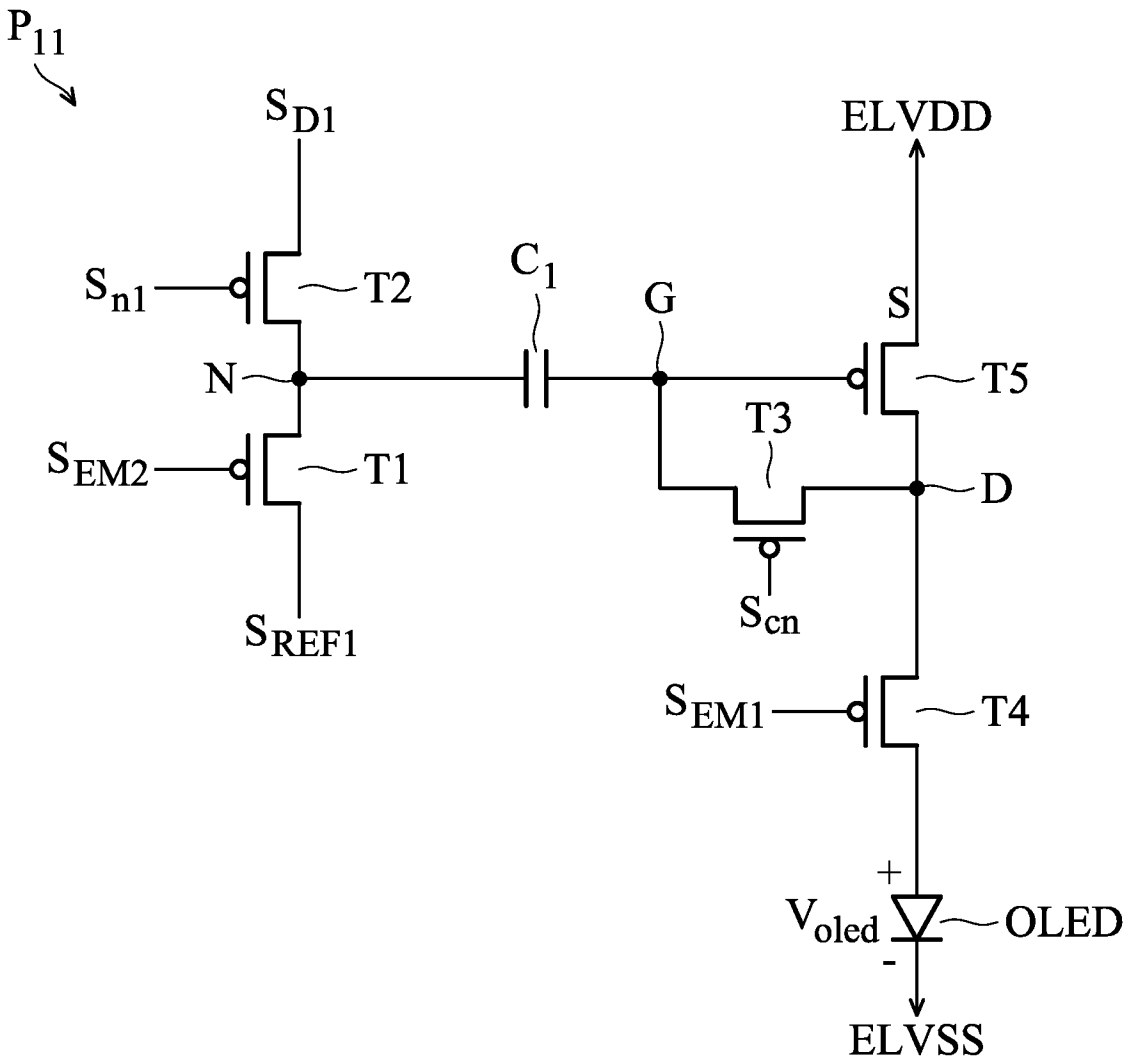
FIG. 2A shows an exemplary embodiment of a pixel structure, according to various aspects of the present disclosure.

FIG. 2A shows an exemplary embodiment of a pixel structure, according to various aspects of the present disclosure. In this embodiment, the pixel P11 comprises a switching transistor T1, a data transistor T2, a compensation transistor T3, an illumination transistor T4, a driving transistor T5, an organic light-emitting diode OLED and a capacitor C1. The transistor T1 and the data transistor T2 are coupled between the data signal SD1 and a reference signal SREF1. The data transistor T2 has a first terminal coupled to the data signal SD1, a second terminal connected to a node N, and a gate terminal coupled to the scan signal Sn1. In this embodiment, the data transistor T2 transmits the data signal SD1 to the node N according to the scan signal Sn1. The switching transistor T1 has a first terminal coupled to the reference signal, a second terminal connected to the node N, and a gate terminal coupled to an illumination signal SEM2. In this embodiment, the switching transistor T1 provides the reference signal SREF1 to the node N according to the illumination signal SEM2. In one embodiment, the reference signal SREF1 is equal to the voltage level Voled of the organic light-emitting diode OLED.

The driving transistor T5, the illumination transistor T4 and the organic light-emitting diode OLED are coupled between operation voltages ELVDD and ELVSS. In one embodiment, the operation voltage ELVDD is a positive voltage and the operation voltage ELVSS is a negative voltage. As shown in FIG. 2A, the first terminal of the driving transistor T5 receives the operation voltage ELVDD. The first terminal of the illumination transistor T4 is coupled to the second terminal of the driving transistor T5. The second terminal of the illumination transistor T4 is coupled to the anode of the organic light-emitting diode OLED. The gate terminal of the illumination transistor T4 receives an illumination signal $S_{EM1}$. In one embodiment, the illumination signal $S_{EM1}$ is the same as the illumination signal $S_{EM2}$. The cathode of the organic light-emitting diode OLED receives the operation voltage ELVSS. In other embodiments, the organic light-emitting diode OLED is replaced by an inorganic light-emitting diode (ILED).

The compensation transistor T3 is coupled between the gate terminal G of the driving transistor T5 and the second terminal D of the driving transistor T5 and receives a control signal $S_{cn}$. The capacitor $C_1$ is coupled between the node N and the gate terminal G of the driving transistor T5. In this embodiment, the transistors T1~T5 are PMOS transistors. In one embodiment, at lease one of the illumination signals $S_{EM1}$ and $S_{EM2}$, the control signal $S_{cn}$, and the reference signal $S_{REF1}$ is provided by the gate driver 110, but the disclosure is not limited thereto. In other embodiments, the reference signal $S_{REF1}$ is provided by a DC power supply.

Figure 2B:
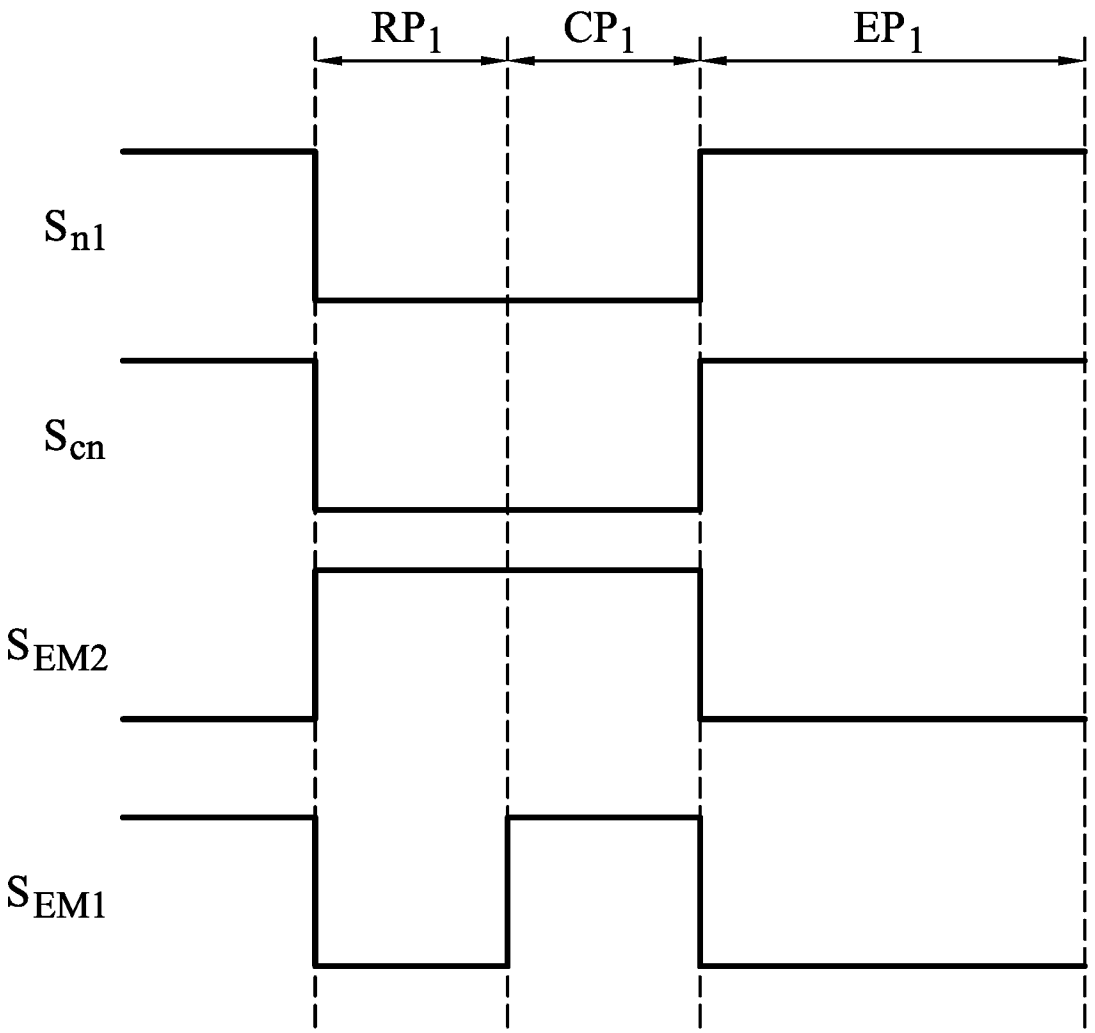
FIGS. 2B-2C are timing diagrams for the pixel structure of FIG. 2A, according to various aspects of the present disclosure.
Figure 2C:
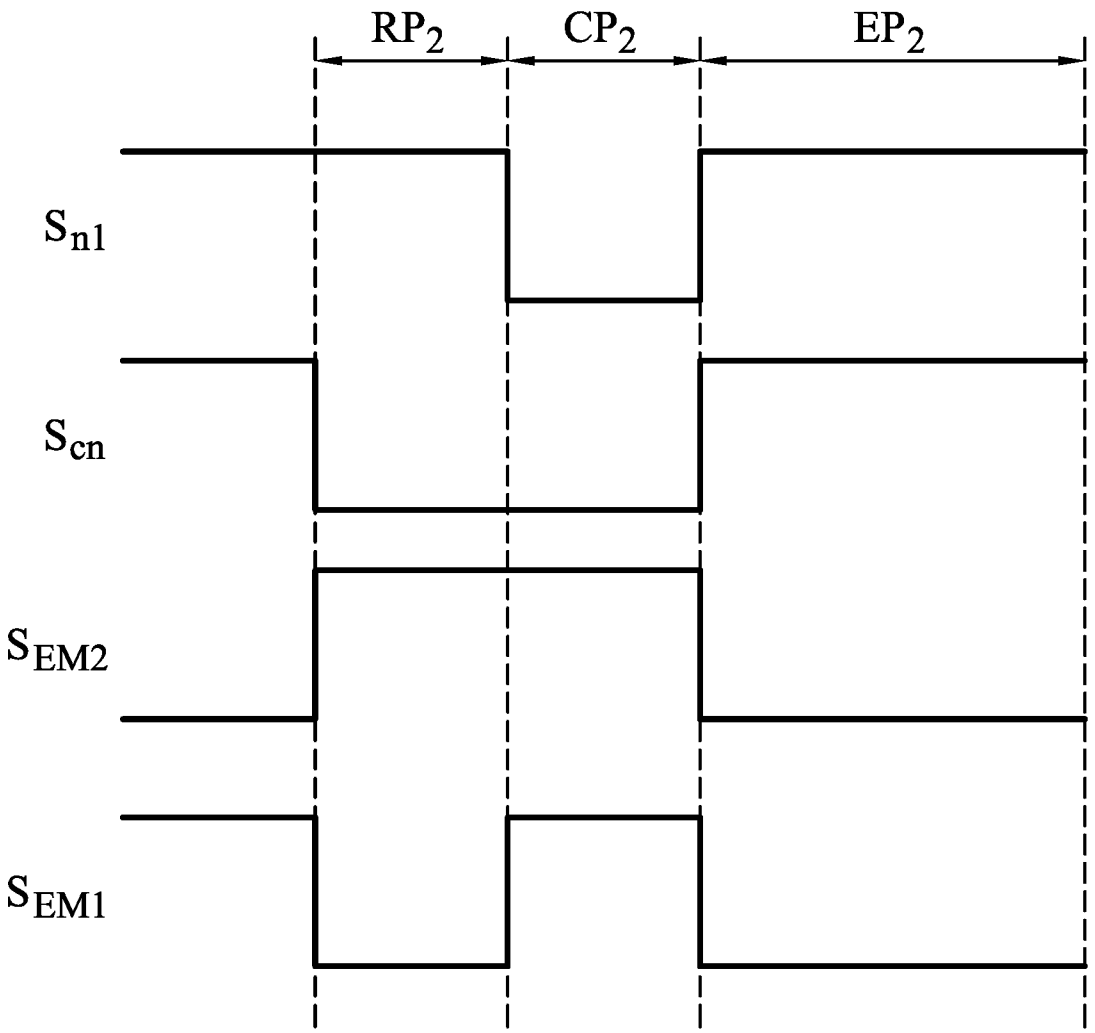

FIG. 2B is a timing diagram for the pixel structure of FIG. 2A, according to various aspects of the present disclosure. Refer to FIG. 2A, during a reset period $RP_1$, the illumination signal $S_{EM2}$ is at a high voltage level, and the scan signal $S_{n1}$, the control signal $S_{cn}$ and the illumination signal $S_{EM1}$ are at a low voltage level. Therefore, the switching transistor T1 is turned off, and the data transistor T2, compensation transistor T3, illumination transistor T4 and driving transistor T5 are turned on. In this period, the voltage level of the node N is equal to the data signal $S_{D1}$. The voltage level of the gate terminal G of the driving transistor T5 is equal to the voltage level $V_{oled}$ of the organic light-emitting diode OLED. In another embodiment, refer to FIG. 2C, during a reset period $RP_2$, the scan signal $S_{n1}$ is at a high voltage level to turn off the data transistor T2. In this case, the voltage level of the node N is a floating level.

During a compensation period $CP_1$, the illumination signals $S_{EM1}$ and $S_{EM2}$ are at the high voltage level, and the scan signal $S_{n1}$ and the control signal $S_{cn}$ are at the low voltage level to turn off the switching transistor T1 and the illumination transistor T4 and turn on the data transistor T2, the compensation transistor T3 and the driving transistor T5. Therefore, the voltage level of the node N is equal to the data signal $S_{D1}$ and the voltage level $V_G$ of the gate terminal G of the driving transistor T5 is equal to a first sum of the operation voltage ELVDD and an absolute value $|V_{TH}|$ of a threshold voltage $V_{TH}$ of the driving transistor T5. In other words, the voltage level $V_G$ is equal to ELVDD+$|V_{TH}|$ during the compensation period $CP_1$.

During an illumination period $EP_1$, the scan signal $S_{n1}$ and the control signal $S_{CN}$ are at the high voltage level and the illumination signals $S_{EM1}$ and $S_{EM2}$ are at the low voltage level to turn off the data transistor T2 and the compensation transistor T3 and turn on the switching transistor T1, the illumination transistor T4 and the driving transistor T5. Therefore, the voltage level of the node N is equal to a difference between the reference signal $S_{REF1}$ and the data signal $S_{D1}$ (i.e. $S_{REF1}-S_{D1}$). In this period, the voltage level $V_G$ of the gate terminal G of the driving transistor T5 is equal to ELVDD+$|V_{TH}|$+($S_{REF1}-S_{D1}$). During the illumination period $EP_1$, the driving transistor T5 generates a driving current I according to the voltage difference between the gate terminal G and the first terminal S of the driving transistor T5 to drive the organic light-emitting diode OLED. The driving current I is expressed by the following equation (1):

$$I=K(V_{GS}-V_{TH})^2 \quad (1)$$

Equation (1) is combined with the voltage levels of the gate terminal G and the first terminal S of the driving transistor T5 and the combined result is expressed by the following equation (2):

$$I=K(S_{REF1}-S_{D1})^2 \quad (2)$$

According to equation (2), the driving current I is not altered by the threshold voltage $V_{TH}$ of the driving transistor T5 and the operation voltage ELVDD.

In one embodiment, if the switching transistor T1 is coupled to the anode of the organic light-emitting diode OLED, the voltage level of the node N is equal to the difference between the voltage level $V_{oled}$ of the organic light-emitting diode OLED and the data signal $S_{D1}$ (i.e. $V_{oled}-S_{D1}$), and the voltage level $V_G$ of the gate terminal G of the driving transistor T5 is equal to EVLDD+$|V_{TH}|$+($V_{oled}-S_{D1}$). The Equation (1) is combined with the voltage level of the gate terminal G of the driving transistor T5 and the combined result is expressed by the following equation (3):

$$I=K(V_{oled}-S_{D1})^2 \quad (3)$$

According to equation (3), the driving current I is not altered by the threshold voltage $V_{TH}$ of the driving transistor T5 and the operation voltage ELVDD. Therefore, when the switching transistor T1 is coupled to the anode of the organic light-emitting diode OLED or receives the reference signal $S_{REF1}$, the driving current I is not interfered by the threshold voltage $V_{TH}$ of the driving transistor T5 or the operation voltage ELVDD during the illumination period.

In some embodiments, during the illumination period $EP_1$, the time point when the illumination transistor T4 is turned on is different from the time point when the driving transistor T5 is turned on to avoid coupling.

Figure 3A:
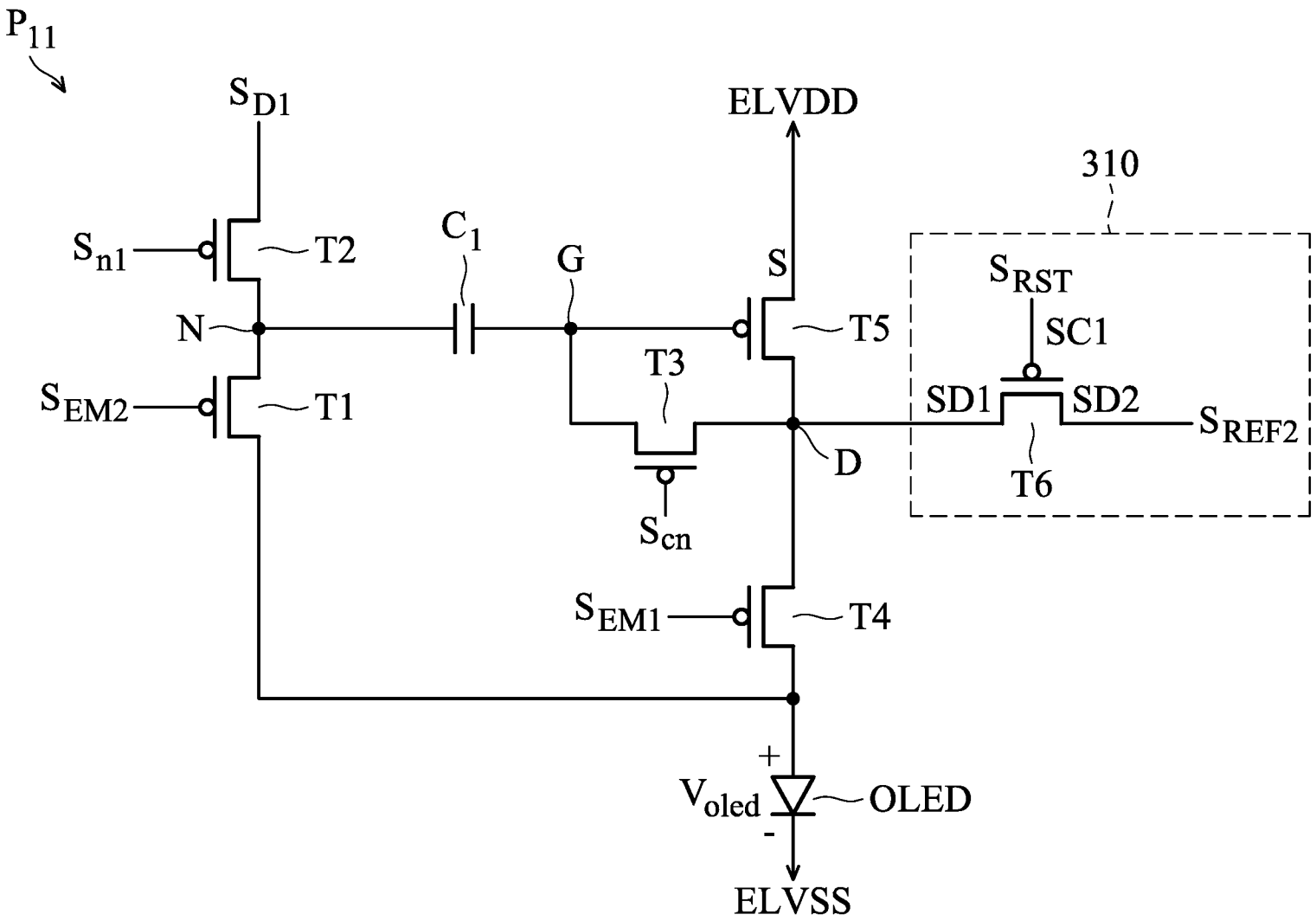
FIG. 3A shows another exemplary embodiment of a pixel structure, according to various aspects of the present disclosure.

FIG. 3A shows another exemplary embodiment of a pixel structure, according to various aspects of the present disclosure. FIG. 3A is similar to FIG. 2A except for the addition of a reset module 310. The reset module 310 is configured to provide a reference signal $S_{REF2}$ to the second terminal of the driving transistor T5. In one embodiment, the reference signal $S_{REF2}$ is less than the operation voltage ELVSS. Additionally, in this embodiment, the first terminal of the switching transistor T1 is coupled to the anode of the organic light-emitting diode OLED, but the disclosure is not limited thereto. In some embodiments, the first terminal of the switching transistor T1 receives a reference signal $S_{REF1}$. In this case, the reference signal $S_{REF1}$ is greater than the reference signal $S_{REF2}$. In one embodiment, the reference signals $S_{REF1}$ and $S_{REF2}$ are provided by a DC power supply.

The reset module 310 comprises a reset transistor T6 to provide the reference signal $S_{REF2}$. In this embodiment, the gate terminal SC1 of the reset transistor T6 receives a reset signal $S_{RST}$. The first terminal SD1 of the reset transistor T6 is coupled to the second terminal of the driving transistor T5. The second terminal SD2 of the reset transistor T6 receives the reference signal $S_{REFs}$. When the reset signal $S_{RST}$ is at a low voltage level, the reset transistor T6 provides the reference signal $S_{REF2}$ to the second terminal of the driving transistor T5. In one embodiment, the reference signal $S_{REF2}$ is the same as the voltage level $V_{oled}$ of the organic light-emitting diode OLED.

Figure 3B:
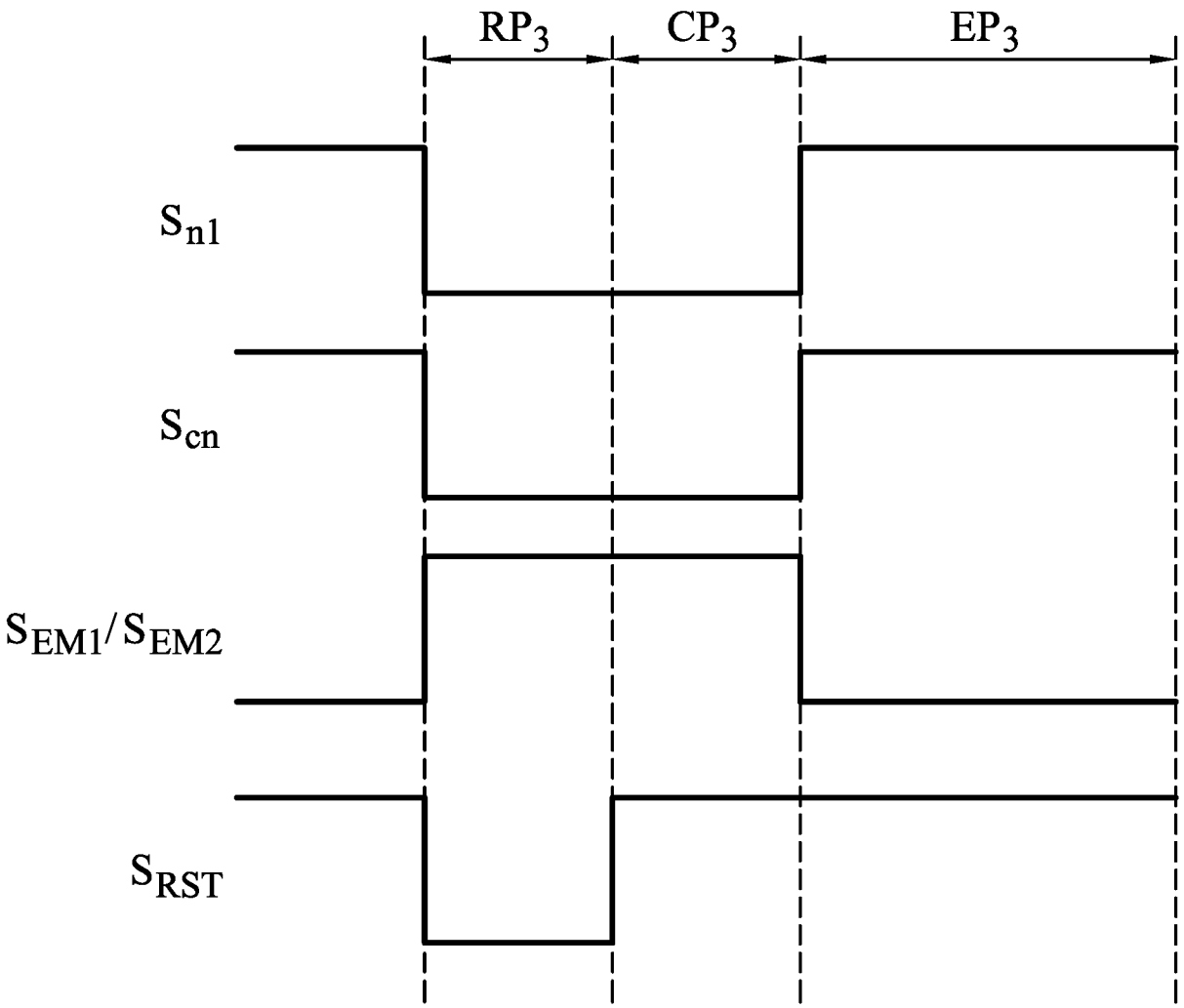
FIG. 3B is a timing diagram for the pixel structure shown in FIG. 3A, according to various aspects of the present disclosure.

FIG. 3B is a timing diagram for the pixel structure shown in FIG. 3A, according to various aspects of the present disclosure. Refer to FIG. 3A, during a reset period $RP_2$, the illumination signals $S_{EM1}$ and $S_{EM2}$ are at the high voltage level, and the scan signal $S_{n1}$, the control signal $S_{cn}$ and the reset signal $S_{RST}$ are at the low voltage level. Therefore, the switching transistor T1 and the illumination transistor T4 are turned off, and the data transistor T2, the compensation transistor T3, the driving transistor T5 and the reset transistor T6 are turned on. At this time, the voltage level of the node N is equal to the data signal $S_{D1}$ and the voltage level of the gate terminal G of the driving transistor T5 is equal to the reference signal $S_{REF2}$.

During a compensation period $CP_2$, the illumination signals $S_{EM1}$ and $S_{EM2}$ and the reset signal $S_{RST}$ are at the high voltage level, and the scan signal $S_{n1}$ and the control signal $S_{cn}$ are at the low voltage level. Therefore, the switching transistor T1, the illumination transistor T4 and the reset transistor T6 are turned off, and the data transistor T2, the compensation transistor T3 and the driving transistor T5 are turned on. In this period, the voltage level of the node N is equal to the data signal $S_{D1}$, and the voltage level of the gate terminal G of the driving transistor T5 is equal to the sum of the operation voltage ELVDD and the absolute value $|V_{TH}|$ of the threshold voltage $V_{TH}$ of the driving transistor T5 (i.e. ELVDD+$|V_{TH}|$).

In an illumination period EP2, the scan signal Sn1, the control signal Scn and the reset signal SRST are at the high level, and the illumination signals SEM1 and SEM2 are at the low level. Therefore, the data transistor T2, the compensation transistor T3 and the reset transistor T6 are turned off, and the switching transistor T1, the illumination transistor T4 and the driving transistor T5 are turned on. In this period, the voltage level of the node N is equal to a difference between the voltage level Voled of the organic light-emitting diode OLED and the data signal SD1 (i.e. Voled−SD1), and the voltage level VG of the gate terminal G of the driving transistor T5 is equal to the sum of the operation voltage ELVDD, the absolute value of the threshold voltage VTH of the driving transistor T5 (i.e. ELVDD+) and the difference between the voltage level Voled of the organic light-emitting diode OLED and the data signal SD1 (i.e. VG=ELVDD+ +(Voled−SD1)). Since the voltage level of the scan signal Sn1 is the same as the voltage level of the control signal Scn, the scan signal Sn1 is utilized to control the compensation transistor T3.

Figure 4:
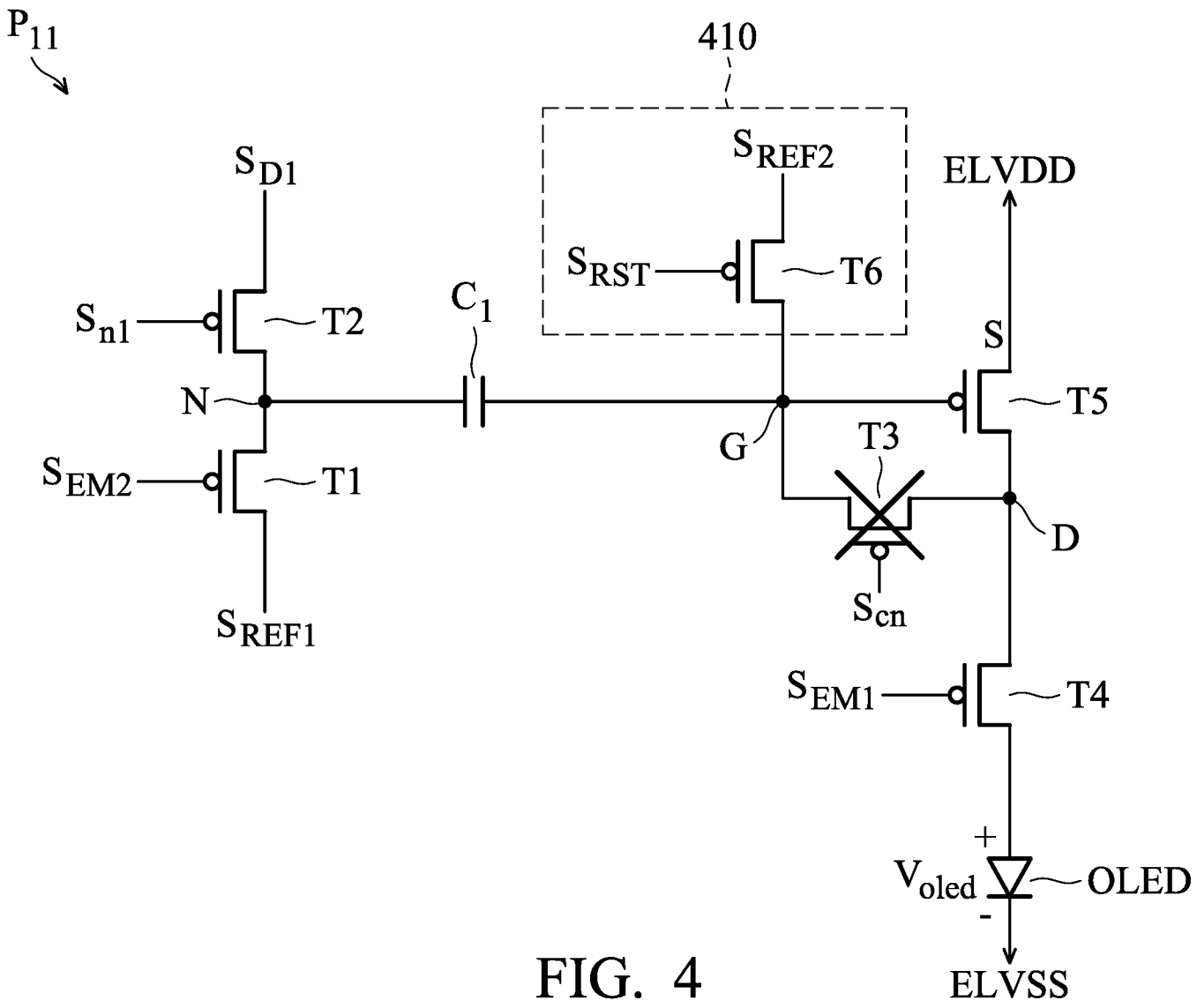
FIG. 4 shows another exemplary embodiment of a pixel structure, according to various aspects of the present disclosure.

FIG. 4 shows another exemplary embodiment of a pixel structure, according to various aspects of the present disclosure. FIG. 4 is similar to FIG. 3A with the exception that the reset module 410 is coupled to the gate terminal G of the driving transistor T5. In this embodiment, the first terminal of the switching transistor T1 receives the reference signal $S_{REF1}$, but the disclosure is not limited thereto. In some embodiments, the first terminal of the switching transistor T1 is coupled to the anode of the organic light-emitting diode OLED. Furthermore, the reference signal $S_{REF2}$ may be equal to the voltage level $V_{oled}$ of the organic light-emitting diode OLED or less than the operation voltage ELVSS. Since the operations of FIGS. 4 and 3A are the same, the description of FIG. 4 is omitted for brevity.

Figure 5:
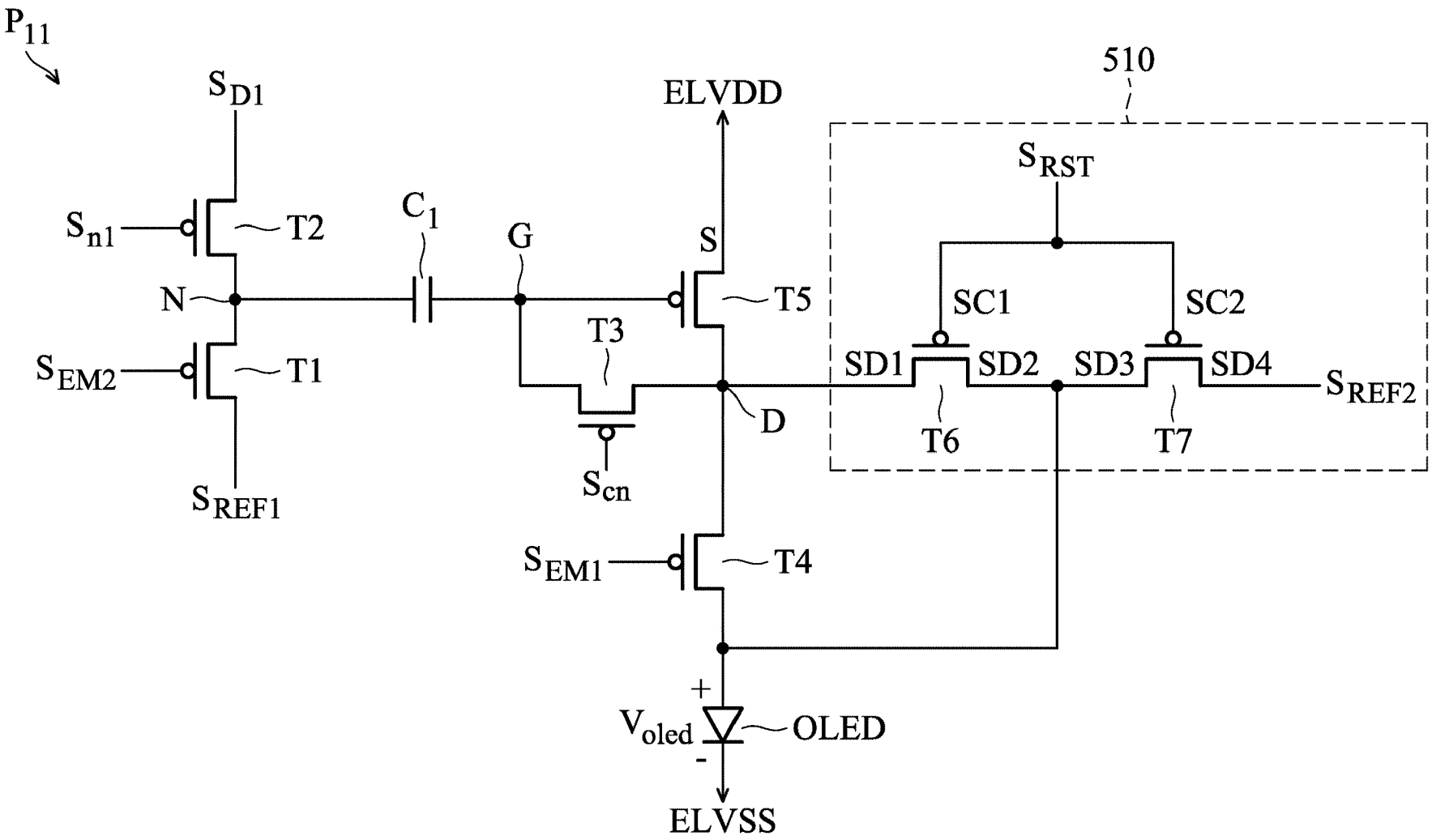
FIG. 5 shows another exemplary embodiment of a pixel structure, according to various aspects of the present disclosure.

FIG. 5 shows another exemplary embodiment of a pixel structure, according to various aspects of the present disclosure. FIG. 5 is similar to FIG. 3A with the exception that the reset module 510 comprises reset transistors T6 and T7. The gate terminal SC1 of the reset transistor T6 receives a reset signal $S_{RST}$. The first terminal SD1 of the reset transistor T6 is coupled to the second terminal D of the driving transistor T5. The second terminal SD2 of the reset transistor T6 is coupled to the anode of the organic light-emitting diode OLED. The gate terminal SC2 of the reset transistor T7 receives the reset signal $S_{RST}$. The first terminal SD3 of the reset transistor T7 is coupled to the second terminal SD2 of the reset transistor T6. The second terminal SD4 of the reset transistor T7 receives the reference signal $S_{REF2}$.

Since the control timing for FIG. 5 is the same as FIG. 3B, the operation of FIG. 4 is omitted for brevity. In this embodiment, during a reset period, the reset transistors T6 and T7 are turned on. Therefore, the reset module 510 provides the reference signal $S_{REF2}$ to the second terminal D of the driving transistor T5 and the anode of the organic light-emitting diode OLED. In one embodiment, the reference signal $S_{REF1}$ is less than the operation voltage ELVSS. Therefore, the operating life of the organic light-emitting diode OLED can be increased.

During a compensation period and an illumination period, the reset transistors T6 and T7 are turned off. Additionally, in this embodiment, the first terminal of the switching transistor T1 receives the reference signal $S_{REF1}$, but the disclosed is not limited thereto. In some embodiments, the first terminal of the switching transistor T1 is coupled to the anode of the organic light-emitting diode OLED.

Figure 6:
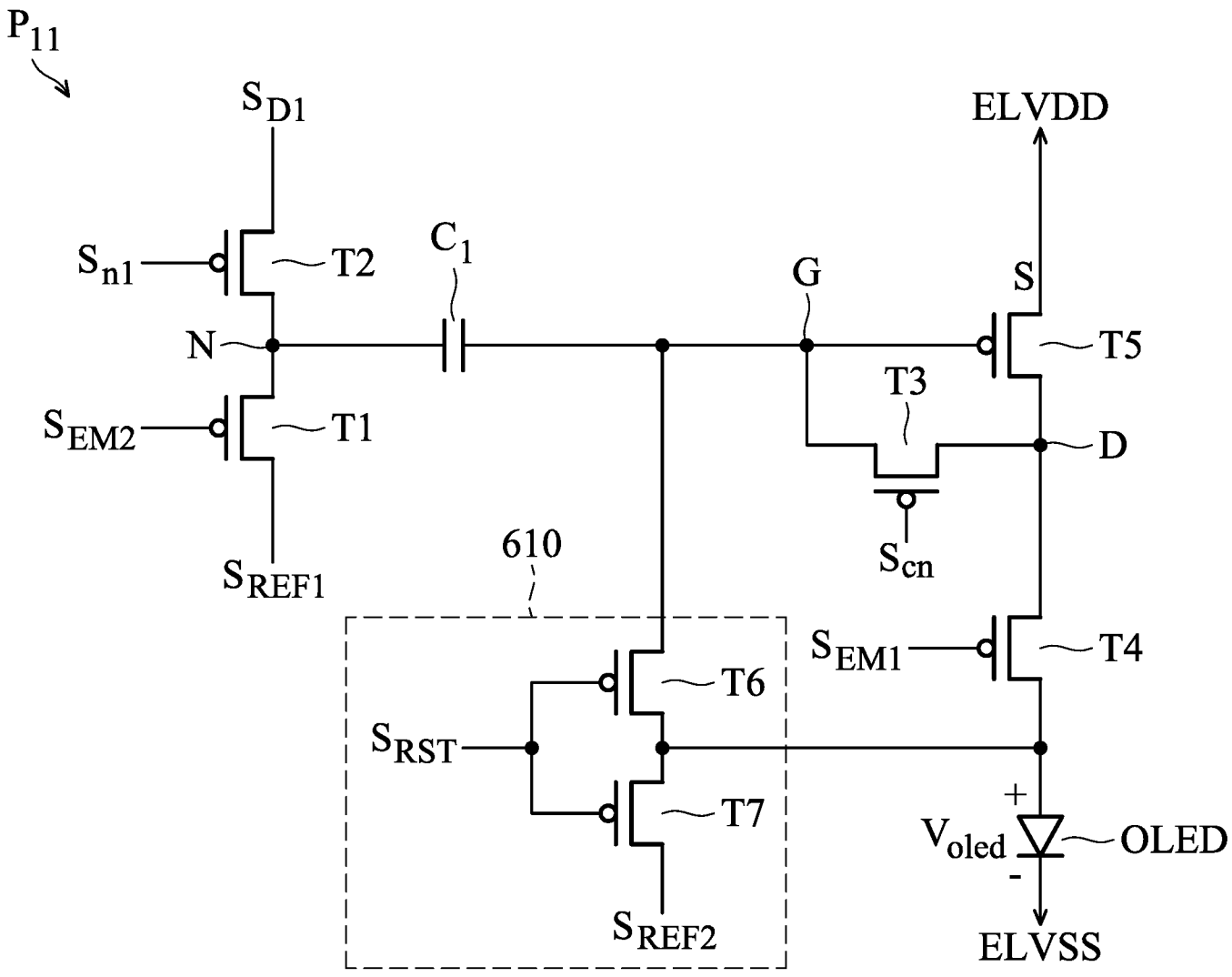
FIG. 6 shows another exemplary embodiment of a pixel structure, according to various aspects of the present disclosure.

FIG. 6 shows another exemplary embodiment of a pixel structure, according to various aspects of the present disclosure. FIG. 6 is similar to FIG. 5 with the exception that the reset module 610 is coupled to the gate terminal G of the driving transistor T5. Since the operations of the reset modules 610 and 510 are the same, the description of the reset module 610 is omitted for brevity. In this embodiment, the first terminal of the switching transistor T1 receives the reference signal $S_{REF1}$, but the disclosure is not limited thereto. In other embodiments, the first terminal of the switching transistor T1 is coupled to the anode of the organic light-emitting diode OLED.

Figure 7A:
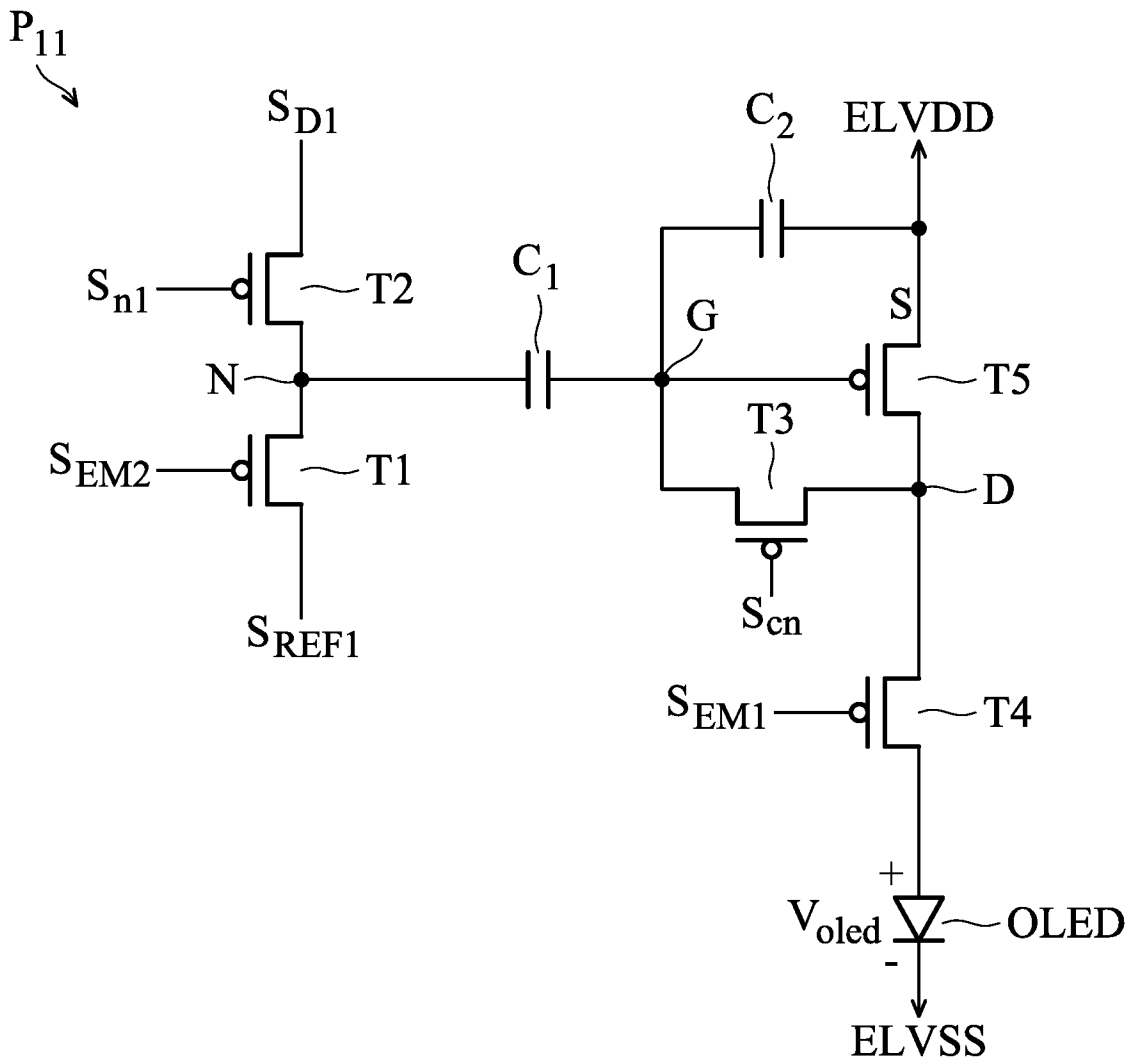
FIGS. 7A and 7B shows other exemplary embodiments of a pixel structure, according to various aspects of the present disclosure.
Figure 7B:
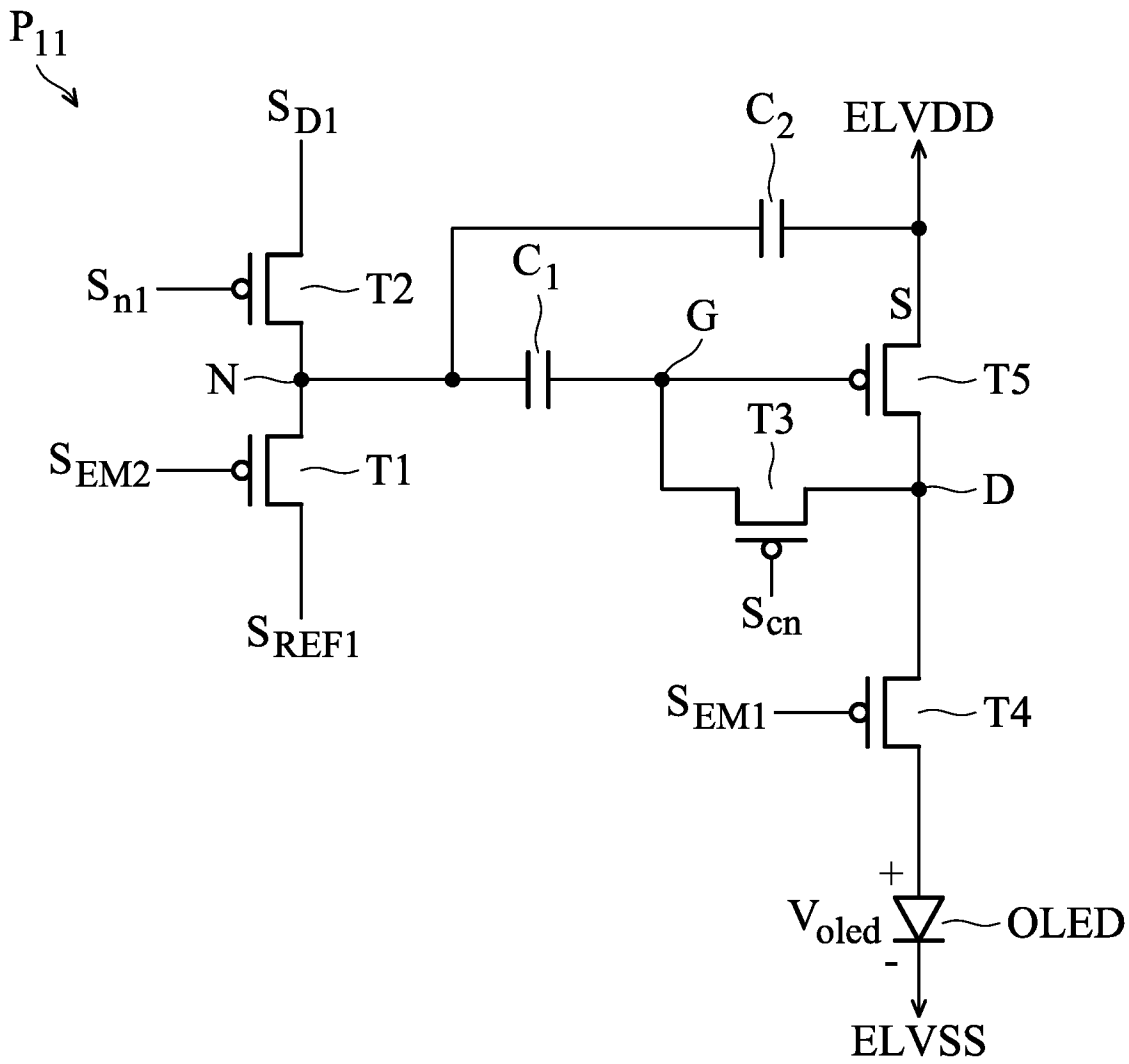

FIGS. 7A and 7B shows other exemplary embodiments of a pixel structure, according to various aspects of the present disclosure. FIG. 7A is similar to FIG. 2A except for the addition of the capacitor $C_2$. As shown in FIG. 7A, the capacitor $C_2$ is coupled between the gate terminal G and the first terminal S of the driving transistor T5, but the disclosure is not limited thereto. In some embodiments, such as in FIG. 7B, the capacitor $C_2$ is coupled between the node N and the first terminal S of the driving transistor T5.

In FIGS. 7A and 7B, the first terminal of the switching transistor T1 receives the reference signal $S_{REF1}$, but the disclosure is not limited thereto. In another embodiment, the first terminal of the switching transistor T1 is coupled to the anode of the organic light-emitting diode OLED. In other embodiments, one of the reset modules 310, 410, 510 and 610 shown in FIG. 3A, 4-6 is applied to FIG. 7A or 7B. Similarly, the capacitor $C_2$ shown in FIG. 7A or 7B may be applied to the pixel structure in FIGS. 2A, 3A and 4-6.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A pixel structure, comprising:

a data transistor having a first terminal coupled to a data signal, a second terminal connected to a node, and a gate terminal coupled to a scan signal;

a switching transistor having a first terminal coupled to a first reference signal, a second terminal connected to the node, and a gate terminal coupled to a first illumination signal;

a driving transistor having a gate terminal, a first terminal coupled to a first operation voltage, and a second terminal;

a compensation transistor having a gate terminal coupled to a control signal, a first terminal connected to the gate terminal of the driving transistor, and a second terminal connected to the second terminal of the driving transistor;

an illumination transistor having a gate terminal coupled to a second illumination signal, a first terminal connected to the second terminal of the driving transistor, and a second terminal;

an organic light-emitting diode (OLED) having an anode coupled to the second terminal of the illumination transistor and a cathode coupled to a second operation voltage;

a reset module configured to provide a second reference signal and comprising:

a first reset transistor having a first gate terminal coupled to a reset signal, a first terminal directly connected to the second terminal or the gate terminal of the driving transistor and a second terminal directly connected to the anode; and a second reset transistor having a second gate terminal coupled to the reset signal, a first terminal coupled to the second terminal of the first reset transistor and a second terminal coupled to the second reference signal; and a first capacitor coupled between the node and the gate terminal of the driving transistor, wherein during a reset period, a voltage level of the gate terminal of the driving transistor is equal to the second reference signal less than the second operation voltage, the first reference signal is the same as the voltage level of the OLED, and the first and second reset transistors are turned on so that the voltage levels of the gate terminal of the driving transistor and the anode are equal to the second reference signal;

wherein during a compensation period, the voltage level of the gate terminal of the driving transistor is equal to a first sum of the first operation voltage and an absolute value of a threshold voltage of the driving transistor; and wherein during an illumination period, the voltage level of the gate terminal of the driving transistor is equal to a second sum of the first sum and a value which is a difference between the second reference signal and the data signal.

2. The pixel structure as claimed in claim 1, wherein the control signal is the same as the scan signal.

3. The pixel structure as claimed in claim 1, wherein the first illumination signal is the same as the second illumination signal.

4. The pixel structure as claimed in claim 1, wherein during the reset period, the switching transistor is turned off and the data transistor, the driving transistor, the illumination transistor and the compensation transistor are turned on to transmit the data signal to the node and direct the voltage level of the gate terminal of the driving transistor is equal to the second reference signal, during the compensation period, the data transistor, the driving transistor and the compensation transistor are turned on and the switching transistor and the illumination transistor are turned off, during the illumination period, the data transistor and the compensation transistor are turned off and the switching transistor, the driving transistor and the illumination transistor are turned on so that a voltage level of the node is equal to a difference between the voltage level of the OLED and the data signal.

5. The pixel structure as claimed in claim 1, wherein during the reset period, the data transistor and the switching transistor are turned off and the driving transistor, the illumination transistor and the compensation transistor are turned on so that the voltage level of the gate terminal of the driving transistor is equal to the second reference signal, during the compensation period, the data transistor, the driving transistor and the compensation transistor are turned on to provide the data signal to the node and the switching transistor and the illumination transistor are turned off, during the illumination period, the data transistor and the compensation transistor are turned off and the switching transistor, the driving transistor and the illumination transistor are turned on so that a voltage level of the node is equal to a difference between the voltage level of the OLED and the data signal.

6. The pixel structure as claimed in claim 1, wherein the first terminal of the first reset transistor is directly connected to the gate terminal of the driving transistor.

7. The pixel structure as claimed in claim 1, wherein during the reset period, the switching transistor and the illumination transistor are turned off and the data transistor, the driving transistor, the compensation transistor and the reset module are turned on to transmit the data signal to the node, during the compensation period, the data transistor, the driving transistor and the compensation transistor are turned on and the switching transistor, the illumination transistor and the reset module are turned off, during the illumination period, the data transistor, the compensation transistor and the reset module are turned off and the switching transistor, the illumination transistor and the driving transistor are turned on.

8. The pixel structure as claimed in claim 1, wherein the level of the second reference signal is less than the level of the first reference signal.

9. The pixel structure as claimed in claim 1, further comprising:

a second capacitor coupled between the gate terminal of the driving transistor and the first terminal of the driving transistor.

10. The pixel structure as claimed in claim 1, further comprising:

a second capacitor coupled between the first terminal of the driving transistor and the node.

11. An electronic device comprising:

a gate driver providing at least one scan signal;

a source driver providing at least one data signal; and a plurality of pixels, each comprising:

a data transistor having a first terminal coupled to the data signal, a second terminal connected to a node, and a gate terminal coupled to the scan signal;

a switching transistor having a first terminal coupled to a first reference signal, a second terminal connected to the node, and a gate terminal coupled to a first illumination signal;

a driving transistor having a gate terminal, a first terminal coupled to a first operation voltage and a second terminal;

a compensation transistor having a gate terminal coupled to a control signal, a first terminal connected to the gate terminal of the driving transistor, and a second terminal connected to the second terminal of the driving transistor;

an illumination transistor having a gate terminal coupled to a second illumination signal, a first terminal connected to the second terminal of the driving transistor, and a second terminal;

an organic light-emitting diode (OLED) having an anode coupled to the second terminal of the illumination transistor and a cathode coupled to a second operation voltage;

a reset module configured to provide a second reference signal and comprising:

a first reset transistor having a first gate terminal coupled to a reset signal, a first terminal directly connected to the second terminal or the gate terminal of the driving transistor and a second terminal directly connected to the anode; and a second reset transistor having a second gate terminal coupled to the reset signal, a first terminal coupled to the second terminal of the first reset transistor and a second terminal coupled to the second reference signal; and a first capacitor coupled between the node and the gate terminal of the driving transistor, wherein during a reset period, a voltage level of the gate terminal of the driving transistor is equal to the second reference signal less than the second operation voltage, the first reference signal is the same as the voltage level of the OLED, and the first and second reset transistors are turned on so that the voltage levels of the gate terminal of the driving transistor and the anode are equal to the second reference signal;

wherein during a compensation period, the voltage level of the gate terminal of the driving transistor is equal to a first sum of the first operation voltage and an absolute value of a threshold voltage of the driving transistor; and wherein during an illumination period, the voltage level of the gate terminal of the driving transistor is equal to a second sum of the first sum and a value which is a difference between the second reference signal and the data signal.

12. The electronic device as claimed in claim 11, wherein the first and second illumination signals, the control signal, the first and second reference signals are provided by the gate driver or a DC power supply.

13. The electronic device as claimed in claim 11, wherein the second reference signal is less than the first reference signal.

* * * * *